United States Patent [19]

Hackauf

[11] Patent Number: 4,533,290

[45] Date of Patent: Aug. 6, 1985

[54] FORK-LIFT ATTACHMENT WITH FOUR LATERALLY DISPLACEABLE PRONGS

[75] Inventor: Klaus-Dieter Hackauf, Braunschweig-Timmerlah, Fed. Rep. of Germany

[73] Assignee: Hans H. Meyer GmbH Maschinenbau, Salzgitter, Fed. Rep. of Germany

[21] Appl. No.: 571,857

[22] Filed: Jan. 18, 1984

[30] Foreign Application Priority Data

Jan. 19, 1983 [DE] Fed. Rep. of Germany ..... 3301595

[51] Int. Cl.[3] ..... B66F 9/12

[52] U.S. Cl. ..... 414/667; 414/671

[58] Field of Search ..... 414/662, 663, 664, 665, 414/666, 667, 668, 669, 670, 671; 211/105.3

[56] References Cited

U.S. PATENT DOCUMENTS

| | | | |
|---|---|---|---|
| 2,958,436 | 11/1960 | Skutle et al. | 414/667 |
| 2,985,328 | 5/1961 | Fitch | 414/667 |
| 3,545,636 | 12/1970 | Yarbrough, Jr. | 414/671 |
| 3,684,113 | 8/1972 | Roller | 414/667 X |

FOREIGN PATENT DOCUMENTS

| | | | |
|---|---|---|---|
| 342500 | 4/1978 | Austria . | |
| 677102 | 11/1964 | Italy | 414/667 |

OTHER PUBLICATIONS

"Deutsche Hebe— und Fördertechnik", No. 2/73, (Das Angebot Des Markts), Feb. 1973, pp. 90 and 92.

*Primary Examiner*—Robert J. Spar
*Assistant Examiner*—Ken Muncy
*Attorney, Agent, or Firm*—Karl F. Ross; Herbert Dubno

[57] ABSTRACT

An attachment for a fork-lift truck has a vertical support plate, secured to an adjacent lifting plate of the truck and laterally shiftable therealong by a fluidic jack, which is provided with two pairs of vertically spaced, horizontal guide rails slidably engaged by complementarily profiled pairs of mounting rails which are rigid with two outer prongs shiftable relatively to the support plate by two further jacks. Two inner prongs frictionally engage the mounting rails of the respectively adjoining outer prongs for lateral entrainment thereby between limits defined by adjustable stops on the support plate.

10 Claims, 2 Drawing Figures

FORK-LIFT ATTACHMENT WITH FOUR LATERALLY DISPLACEABLE PRONGS

FIELD OF THE INVENTION

Our present invention relates to an attachment for a fork-lift truck comprising four generally L-shaped prongs usable for lifting and transporting one or two pallets at a time.

BACKGROUND OF THE INVENTION

From the German publication "Deutsche Hebe- und Fördertechnik", No. 2/73 of February, 1973, pages 90 and 92, an attachment of this type is known which comprises two juxtaposed vertical support plates carrying respective pairs of prongs, these plates being secured to the front face of a vertical lifting plate of a fork-lift truck for joint raising and lowering along with any load engaged thereby. That assembly is somewhat unwieldy since, on the one hand, the lifting plate must be wide enough to hold the two support plates and, on the other hand, the mechanism required for a lateral shifting of the prongs—to accommodate single or double pallets—is quite complex.

An improved attachment of this character is disclosed in Austrian Pat. No. 342,500 and comprises a common support plate for the two outer and the two inner prongs. The outer prongs are linked with the support plate by a pair of fluidic jacks enabling their relative lateral displacement. The inner prongs can be entrained by the outer prongs over part of their travel, by couplers not particularly described, or can be loaded by compression springs tending to separate them when the outer prongs are moved farther apart. The support plate has a width only slightly less than the maximum separation of the outer prongs, the difference resulting from a generally Z-shaped horizontal profile of the upright legs of the outer prongs forming rabbets which accommodate the upright legs of the adjoining inner prongs in a contracted position in which all four prongs are closely grouped for engagement with a single pallet.

OBJECT OF THE INVENTION

The object of our present invention is to provide an attachment of the type referred to which enables a considerable reduction in the width of the support plate and also simplifies the structure of the prongs in comparison with that of the Austrian patent.

SUMMARY OF THE INVENTION

Such a four-prong attachment, in accordance with our present invention, comprises two pairs of horizontal guide rails which are fixedly mounted in vertically spaced-apart positions on the support plate and have profiles complementary to those of two pairs of vertically separated horizontal mounting rails respectively engaged thereby, each pair of mounting rails being secured to the upright leg of an outer prong and extending toward the other outer prong. Two fluidic jacks anchored to the support plate are linked with the outer prongs and are selectively operable to shift them laterally in either direction as known per se from the Austrian patent cited above. In contrast to the known arrangement, however, the upright leg of each inner prong is provided with holding means frictionally engaging the pair of mounting rails secured to the respectively adjoining outer prong for bidirectional entrainment by the latter prong upon a shifting thereof by the respective jack. The range of lateral displacement of the inner prongs is defined by abutment means arresting these prongs in internal and external limiting positions thereof while enabling further shifting of the outer prongs by the jacks; the abutment means may be carried on the support plate either directly or through the intermediary of the guide rails fixed thereto.

Advantageously, the holding means frictionally coupling the upright leg of each inner prong with an associated pair of mounting rails comprise an upper and a lower hook reaching around these mounting rails in a relatively inverted position, e.g. from above in the case of the upper hook and from below in the case of the lower hook. The abutment means may comprise a plurality of stops disposed in line with these hooks for coaction therewith, the stops preferably being adjustably mounted on the support plate for enabling a change of the limiting positions of the inner prongs.

With the stroke of the jacks sufficient to move each of the outer prongs over a distance substantially twice the range of displacement of each inner prong, the width of the support plate may be substantially less than the maximum separation of the outer prongs from each other. Thus, with the guide rails having a length only slightly exceeding the width of the support plate, the two mounting rails carrying each outer prong may be of somewhat lesser length if engaged by only a little more than half the length of the corresponding guide rails.

BRIEF DESCRIPTION OF THE DRAWING

The above and other features of our invention will now be described in detail with reference to the accompanying drawing in which.

SPECIFIC DESCRIPTION

Figure 1:
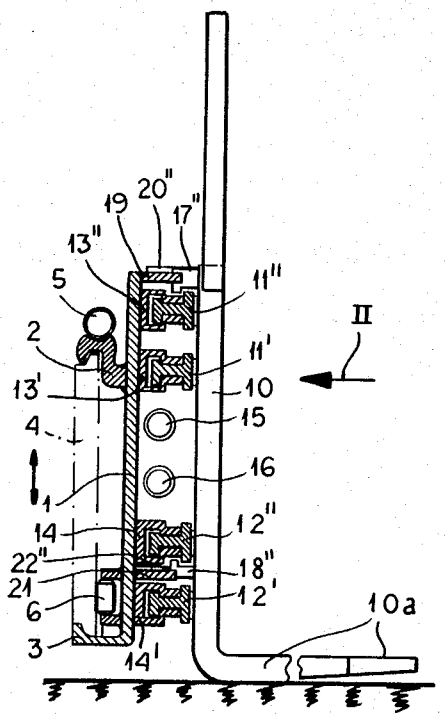
FIG. 1 is a cross-sectional view of a fork-lift attachment according to our invention, taken on the line I—I of FIG. 2.

In FIG. 1 we have indicated in phantom lines a vertical lifting plate 4 of an otherwise nonillustrated conventional fork-lift truck to which a vertical support plate 1 is attached with the aid of an upper and a lower profiled bar 2, 3 slidingly engaging upper and lower edges of plate 4. Plate 1 is further provided with at least two rollers 6, rotatable about vertical axes, which contact the front face of plate 4. A double-acting fluidic jack 5 enables a limited bidirectional horizontal displacement of plate 1 relative to plate 4.

The attachment embodying our invention further comprises two outer prongs 7, 8 and two inner prongs 9, 10 of substantially identical, generally L-shaped structure with coplanar upright legs in front of support plate 1 and with forwardly extending horizontal legs 7*a*, 8*a*, 9*a* and 10*a*, respectively. Outer prongs 7 and 8 are rigid with respective upper and lower horizontal mounting rails 11', 12' and 11'', 12'' extending toward each other in vertically offset relationship and engaging respective guide rails 13', 14' and 13'', 14'' which are fixedly secured to the front surface of support plate 1. These guide rails, which project somewhat beyond the lateral edges of plate 1, have profiles complementary to those of the associated mounting rails which have the shape of I-beams as seen in FIG. 1. Two hydraulic or pneumatic jacks 15 and 16, anchored to support plate 1 midway between rail pairs 13', 13'' and 14', 14'', have pistons 15*a* and 16*a* respectively anchored to prongs 8 and 7. These jacks are selectively pressurizable, by means of nonillustrated valves, to shift the outer prongs between two external positions—illustrated in full lines in FIG. 2—and two internal positions—illustrated in phantom lines—with frictional entrainment of prongs 9 and 10 along part of the way, these latter prongs being independently held on rail pairs 11', 12' and 11'', 12'' by means of upper hooks 17', 17'' and lower hooks 18', 18' respectively secured to their upright legs. Upper hooks 17' and 17'' reach from above around the adjacent flanges of rails 11' and 11'' whereas lower hooks 18' and 18'' reach from below around corresponding flanges of rails 12' and 12''. Hooks 18' and 18'' are shown secured to prongs 9 and 10, respectively, by screws 23' and 23'' enabling their detachment if the inner prongs are to be disengaged from the mounting rails of the associated outer prongs. Thus, the assembly can be quickly converted into a two-prong attachment if this should be desired.

Figure 2:
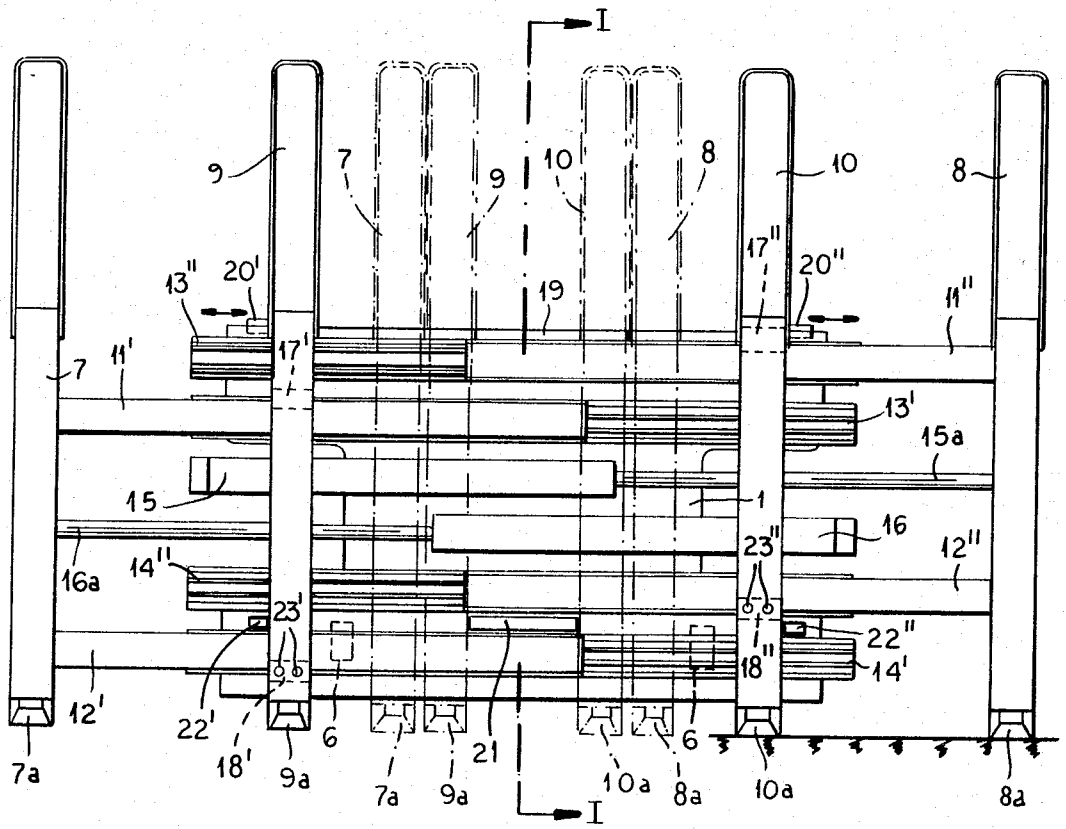
FIG. 2 is a face view in the direction of an arrow II in FIG. 1.

Intermediate stops 19, 21 and outer stops 20', 20'' and 22', 22'' are aligned with hooks 17'' and 18'' and coact therewith to arrest the prongs 9 and 10 in internal and external limiting positions respectively illustrated in phantom and solid lines in FIG. 2. Thus, an inward movement of prongs 7 and 8 from their solid-line external positions into their phantom-line internal positions entrains the prongs 9 and 10 from their solid-line to their phantom-line limiting positions in order that the horizontal legs 7*a*–10*a* of all four prongs can engage a single pallet. Partial retraction of prongs 7 and 8 by jacks 15 and 16 displaces the four prongs from their full-line positions to let prongs 7 and 9 as well as prongs 8 and 10 engage respective pallets by their horizontal legs.

The stops 19, 20', 20'', 21, 22' and 22'' are preferably adjustable on plate 1 to vary the limiting positions of inner prongs 9 and 10. These stops could also coact with other formations on prongs 9 and 10, though the illustrated arrangement is more compact and therefore preferred. Instead of projecting directly from plate 1, these stops could also be disposed on rails 13'' and 14'', for example, though this would be less convenient. All four prongs together, in whatever relative positions they have been placed, can be shifted laterally along with plate 1 by the jack 5.

I claim:

1. A four-prong attachment for a fork-lift truck provided with a vertical lifting plate, comprising:

a vertical support plate attached to said lifting plate forwardly of a front face thereof;

two outer prongs and two inner prongs of generally L-shaped structure with upright legs lying in a plane forward of said support plate, the upright leg of each outer prong being provided with a pair of vertically separated horizontal mounting rails extending toward the other outer prong, said pairs of mounting rails being relatively offset in the vertical direction;

two pairs of horizontal guide rails fixedly mounted in vertically spaced-apart positions on said support plate with profiles complementary to those of said mounting rails, each pair of mounting rails slidably engaging a respective pair of guide rails;

two fluidic jacks respectively linked with said outer prongs and anchored to said support plate, said jacks being selectively operable to shift the respective outer prongs laterally in either direction with reference to said support plate, the upright leg of each inner prong being provided with holding means frictionally engaging the pair of mounting rails secured to the respectively adjoining outer prong for bidirectional entrainment by the latter upon a shifting thereof by the respective jack; and abutment means carried on said support plate for arresting said inner prongs in internal and external limiting positions while enabling further shifting of said outer prongs by said jacks.

2. An attachment as defined in claim 1 wherein said holding means comprises an upper hook and a lower hook on the upright leg of each inner prong, said hooks reaching around respective mounting rails of the adjoining outer prong and being relatively inverted.

3. An attachment as defined in claim 2 wherein at least one of said hooks is detachable for facilitating a separation of the corresponding inner prong from the engaged mounting rails.

4. An attachment as defined in claim 2 wherein said abutment means comprises a plurality of stops disposed in line with said hooks for coaction therewith.

5. An attachment as defined in claim 4 wherein said stops form projections on said support plate.

6. An attachment as defined in claim 4 wherein said stops are adjustably mounted on said support plate for enabling a change of said limiting positions.

7. An attachment as defined in claim 1 wherein the stroke of said jacks is sufficient to move each of said outer prongs over a distance substantially twice the range of displacement of each of said inner prongs.

8. An attachment as defined in claim 7 wherein the width of said support plate is substantially less than the maximum separation of said outer prongs from each other.

9. An attachment as defined in claim 1, further comprising an additional fluidic jack linked with said lifting plate and with said support plate for laterally shifting said support plate together with said prongs relatively to the fork-lift truck.

10. An attachment as defined in claim 9, further comprising a set of rollers on said support plate engageable with the front face of said lifting plate.

* * * * *